United States Patent [19]

Eggerstedt

[11] Patent Number: 4,818,379

[45] Date of Patent: Apr. 4, 1989

[54] SCREENING APPARATUS WITH INTEGRATED DISTRIBUTING AND SEGREGATING DEVICE

[75] Inventor: Karl H. Eggerstedt, Wedel, Fed. Rep. of Germany

[73] Assignee: Fredrik Mogensen AB, Hjo, Sweden

[21] Appl. No.: 26,547

[22] PCT Filed: May 30, 1986

[86] PCT No.: PCT/SE86/00251

§ 371 Date: Feb. 5, 1987

§ 102(e) Date: Feb. 5, 1987

[87] PCT Pub. No.: WO86/07290

PCT Pub. Date: Dec. 18, 1986

[30] Foreign Application Priority Data

Jun. 8, 1985 [DE] Fed. Rep. of Germany ..... 3520614

[51] Int. Cl.[4] ..... B07B 1/40

[52] U.S. Cl. ..... 209/254; 209/247

[58] Field of Search ..... 209/233, 240, 241, 243, 209/247, 253, 254, 311, 315, 352, 353, 355, 357, 356, 363, 370, 373

[56] References Cited

U.S. PATENT DOCUMENTS

| | | | |
|---|---|---|---|
| 1,097,113 | 5/1914 | Wilfley | 209/437 |
| 1,441,870 | 1/1923 | Megraw | 209/284 |
| 1,918,398 | 7/1933 | Johnson | 209/254 |
| 3,032,423 | 5/1962 | Evans | 209/254 |
| 3,092,116 | 6/1963 | Stroburg | 209/254 |
| 3,720,316 | 3/1973 | Riesbeck | 209/254 |
| 3,960,732 | 6/1976 | Lippert | 209/254 |
| 4,234,416 | 11/1980 | Lower | 209/315 |
| 4,568,461 | 2/1986 | Aoustin | 209/254 |
| 4,576,713 | 3/1986 | Melin | 209/254 |

FOREIGN PATENT DOCUMENTS

| | | | |
|---|---|---|---|
| 5544880 | 1/1980 | Australia | 209/247 |
| 526289 | 12/1982 | Australia | 209/247 |
| 0024784 | 3/1981 | European Pat. Off. | 209/247 |

*Primary Examiner*—Joseph F. Peters, Jr.
*Assistant Examiner*—Clifford T. Bartz
*Attorney, Agent, or Firm*—Cushman, Darby & Cushman

[57] ABSTRACT

A screening apparatus of the multi-deck type. The feed inlet space of the screening machine comprises one or more distributing and segregating devices, integrated with the movement of the screening apparatus.

11 Claims, 4 Drawing Sheets

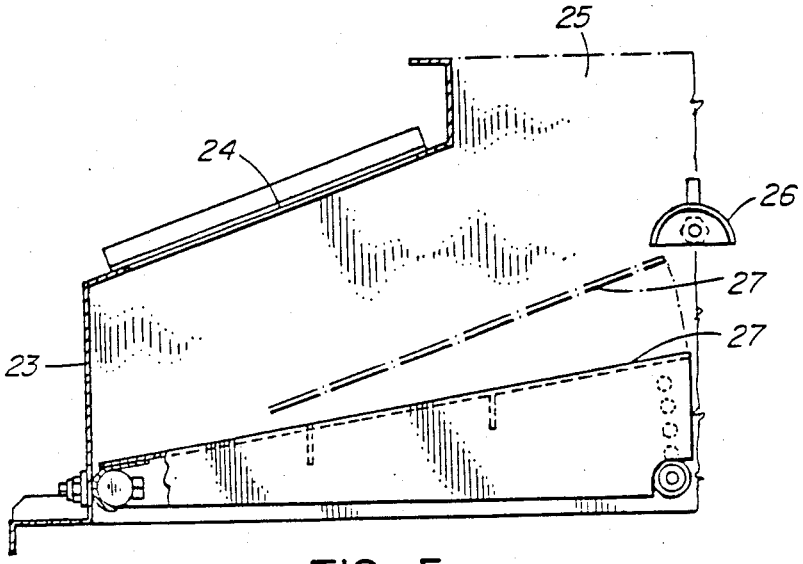
FIG. 5a
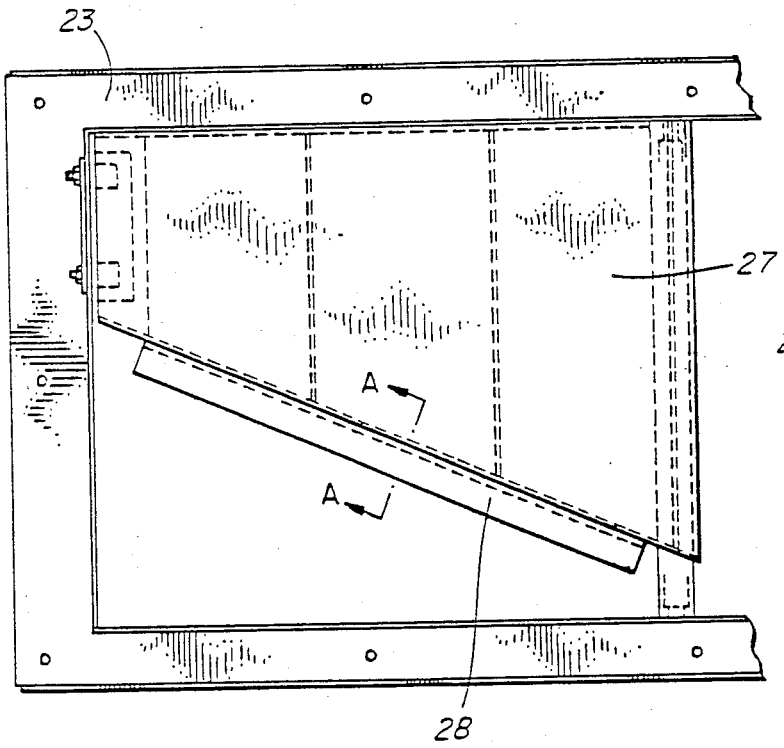
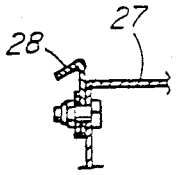
FIG. 5c
FIG. 5b

SCREENING APPARATUS WITH INTEGRATED DISTRIBUTING AND SEGREGATING DEVICE

BACKGROUND OF THE INVENTION

The invention concerns a screening apparatus and is particularly suitable to and intended for screening machines of the multi-deck type.

The manner in which granular materials are being fed to a screen is of vital influence when it comes to achieving optimum capacity and efficiency.

Normally, screens are fed by means of feeding equipment such as conveyors, screws, vibrating feeders, etc. In such cases a more or less even distribution of the material to be screened is achieved prior to the screening apparatus. Often the material will be fed straight on to the screen cloth or the screening apparatus is equipped with a so-called feeder plate onto which the material is brought in order to protect the screen cloths from wear. The material then falls from this feeder plate onto the screen cloth.

This way of feeding has the consequence that the active screening area is not optimally utilized, because certain areas near the inlet are not engaged or the distribution of the material across the width is uneven. Frequently, the bed of material is thicker in the middle than near the sides so that the centre would be overloaded while the outer parts of the screen cloths could take more load.

Further, the material to be screened, which consists of a mixture of fine and coarse particles, must be segregated in the screening process so that the fine particles can be separated from the coarser ones. This happens relatively slowly and the relative capacities per screening surface area are correspondingly small. As a consequence, screens have to be unnecessarily large.

The invention aims at avoiding the disadvantages above and solves the problem of obtaining screening apparatuses where the material, upon arrival at the screen cloths, is evenly distributed and also already to a certain extent segregated, so that the screen cloths can be optimally used for their purpose and the screening apparatuses can be made much smaller, thereby reducing the screening costs considerably.

SUMMARY OF THE INVENTION

To provide this function according to the invention the inlet space of the screening apparatus has one or more distributing and segregating devices which are integrated in the movement of the screening apparatus.

It has also proven advantageous that the distributing and segregating devices are components that are exchangeably attached to the frame of the screening apparatus. The frame then permits different distributing and segregating devices to be attached at the inlet space, to suit the properties of the material and the production. The material can also arrive at the screen from almost any direction and at almost any speed which also requires a selection of distributing and segregating devices. it is then of course important that the same type of attachment to the frame of the screen fits all the different types so that they can be exchanged in a modular fashion.

An example of a distributing and segregating device could be an enclosed box with openings for inlet and outlet to the screen cloths, where the bottom at the inlet space has a roof-like shape and slopes from the centre out towards the sides and where the subsequent part of the bottom has a more shallow flat surface.

Depending upon the type of material to be screened and its properties it can be necessary to include further deflecting or guiding elements. This could be made in the form of a vertically adjustable, distributing profile at a distance above the bottom, before the outlet opening. This distributor could be serrated, castellated, etc. at its lower edge.

For other materials it could be necessary to have deflecting or guiding components attached to the bottom and possibly made adjustable. By means of such parts an even better distribution of the material across the entire width can be arranged. Another example of distributing and segregating device could be a box with one or more inlets, an outlet to the screen cloths and two distributing flaps which slope from the centre towards the sides in a roof-like fashion and which can be set at different slopes. This adjustability of the slope is important because the flowing properties of a material can vary considerably and therefore the slopes have to be adapted to the material to be screened.

The forward or outlet edges of these flaps could be slanting so that the centre part is further than the parts at the sides. Thereby the distribution of the material across the width would be considerably improved. In order to achieve a uniform material flow, there front edges of the distributing flaps could have vertically adjustable guide profiles. The adjacent ends of the two flaps could also be covered by a profile which is positioned above and bridging the gap between the distributing flaps.

BRIEF DESCRIPTION OF THE DRAWINGS

With reference to the enclosed drawings the invention will be further demonstrated:

FIGS. 5*a*, 5*b* and 5*c* show enlarged views of the structure and organisation of the distributing flaps in this device.

DETAILED DESCRIPTION

Figure 1:
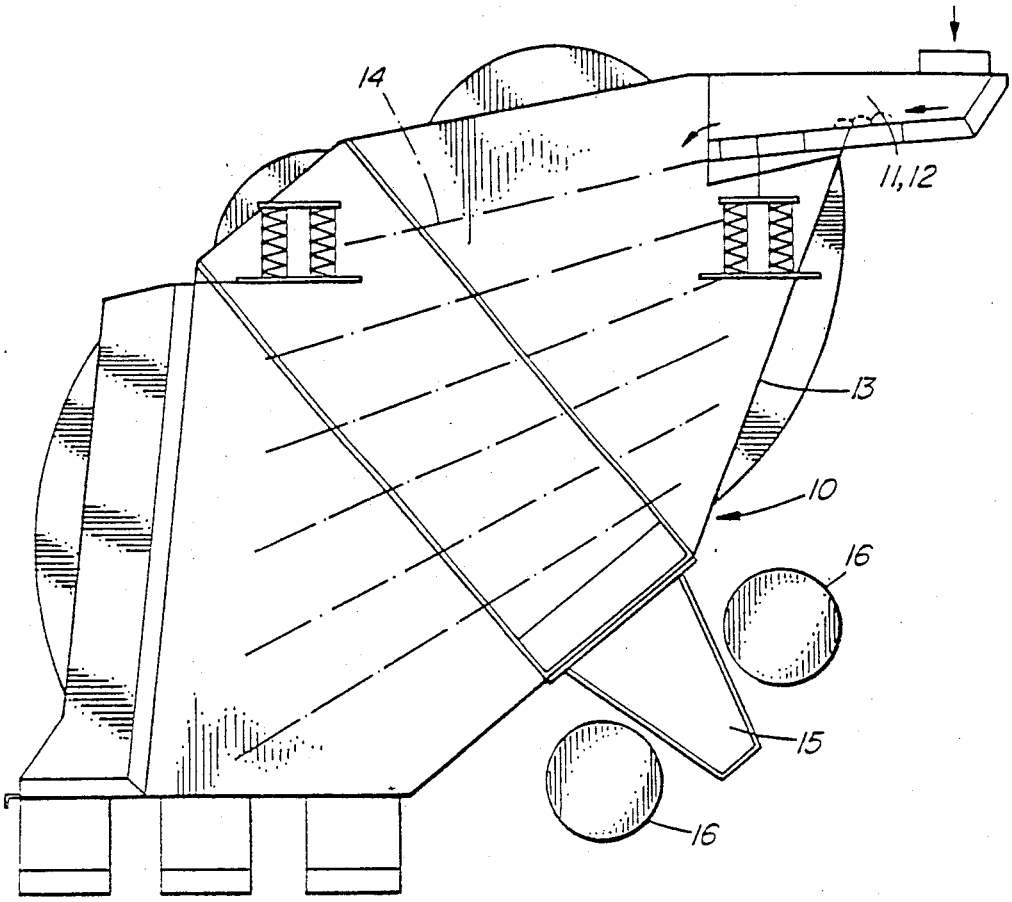
FIG. 1 show schematically a side view of a screening machine with an integrated distributing and segregating device.

FIG. 1 shows how the screening machine 10 consists chiefly of the frame 13 with the screen cloths 14, the vibrator base 15 and the vibrators 16. At the inlet of the screening apparatus, i.e. above and before the top screen cloth 14 there is a distributing and segregating device 11 and 12 attached as a modular component so that a simple adaptation to different requirements is possible by exchange of the device. The length of the distributing and segregating device depends upon several factors like material properties as well as width of the screening apparatus. For very wide screening machines it is possible to use, e.g., two distributing devices side by side and, in practice, have two inlets.

Figure 2A:
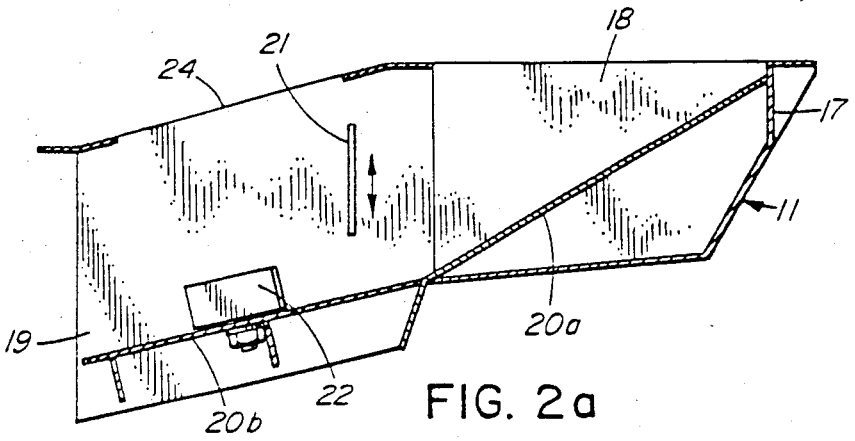
FIGS. 2*a* and 2*b* show an example of a distributing and segregating device according to the invention.
Figure 2B:
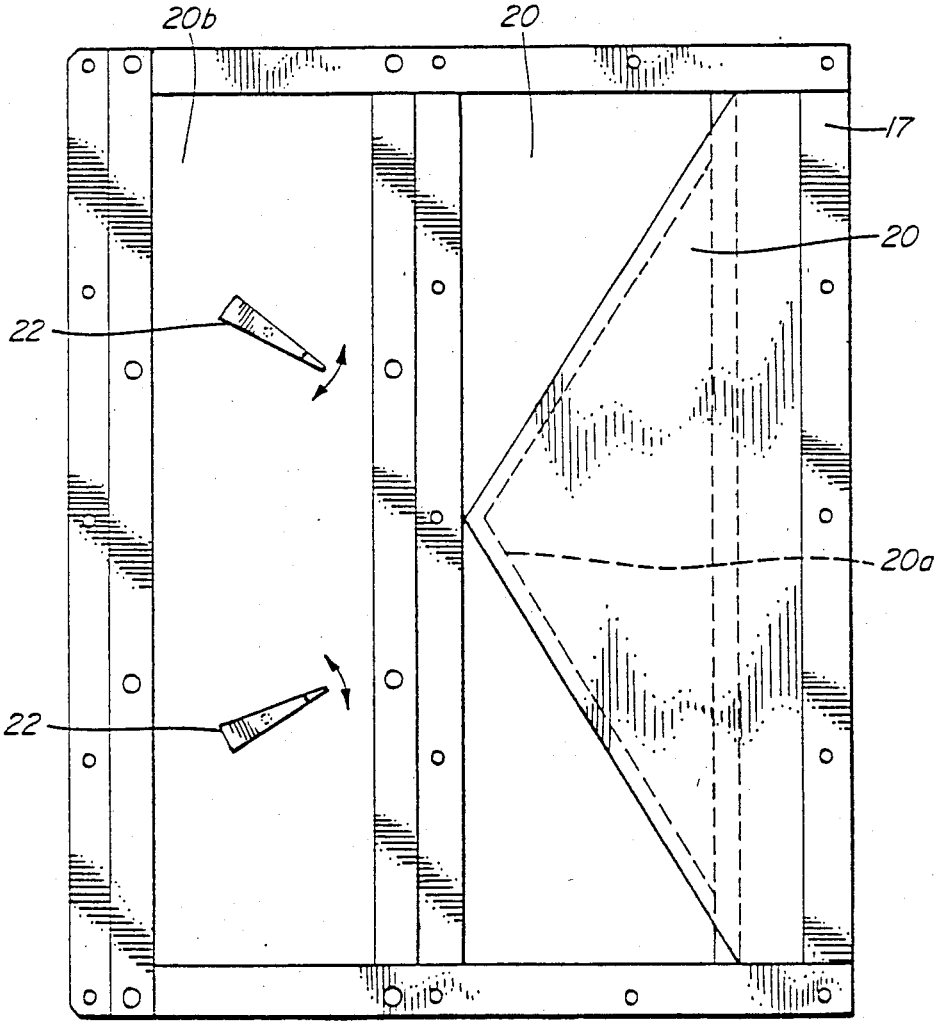
Figure 4A:
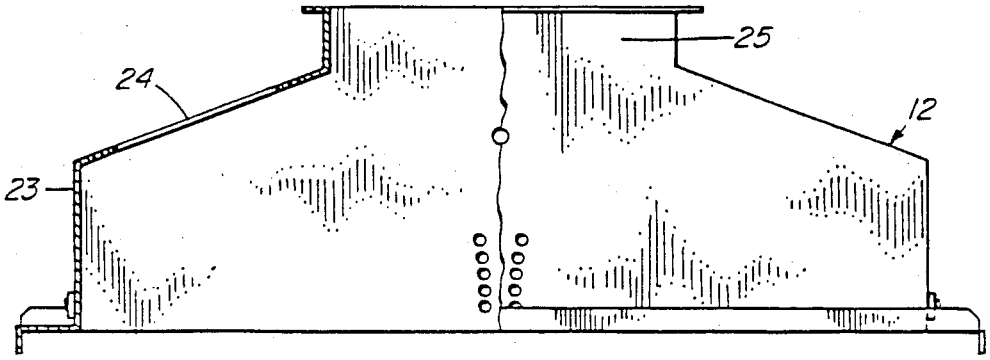
FIGS. 4*a*, 4*b* and 4*c* show another example of a distributing and segregating device.
Figure 4B:
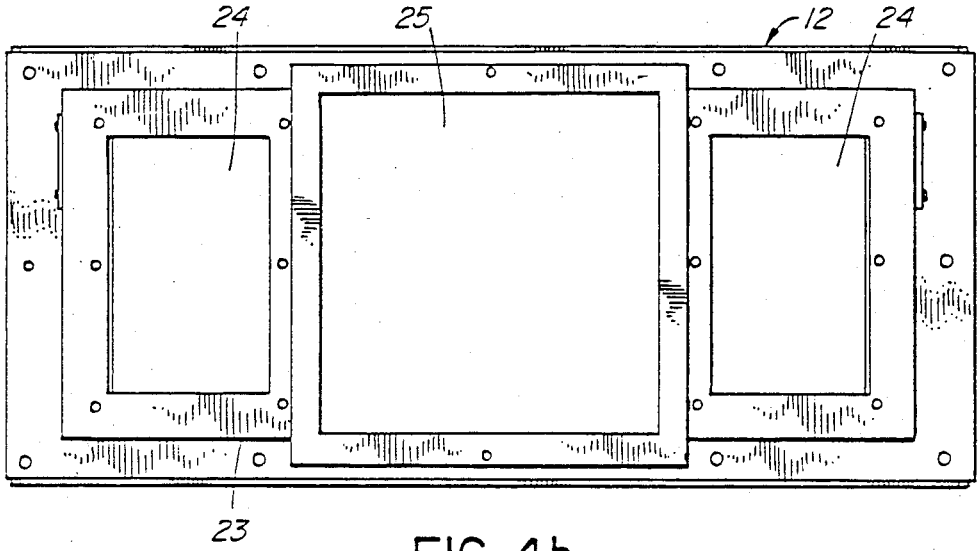
Figure 4C:
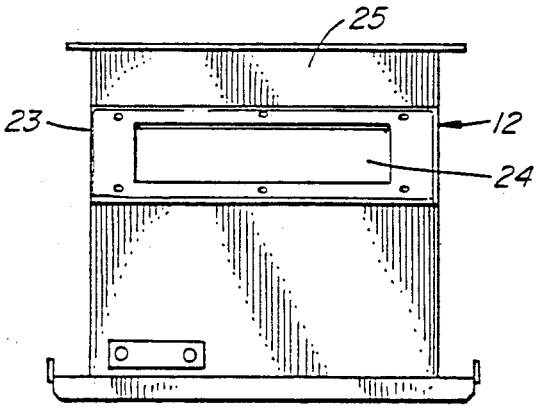

When the material leaves the distributing and segregating device and arrives at the screen cloth it is segregated and distributed completely so that the screening process will be considerably facilitated, i.e., the residence time on the screen cloths will thereby be very much shorter and, accordingly, the specific capacity increased. The distributing and segregating device is in FIG. 2*a* shown in cross-sectional view and in FIG. 2*b* from above. It consists of an inlet opening 18 and an outlet opening 19 which leads to the screen cloths, an enclosed box 17 between the side walls of which a bottom part 20 is arranged. At the inlet base this bottom part is shaped in a roof-like fashion 20*a*, while towards the outlet it consists of a more shallow, flat part. By means of the roof-like bottom part and its saddle-shape the fed material will be distributed sideways. The vibration will then transport the material towards the outlet and the screen cloths and at the same time segregate it.

Figure 3:
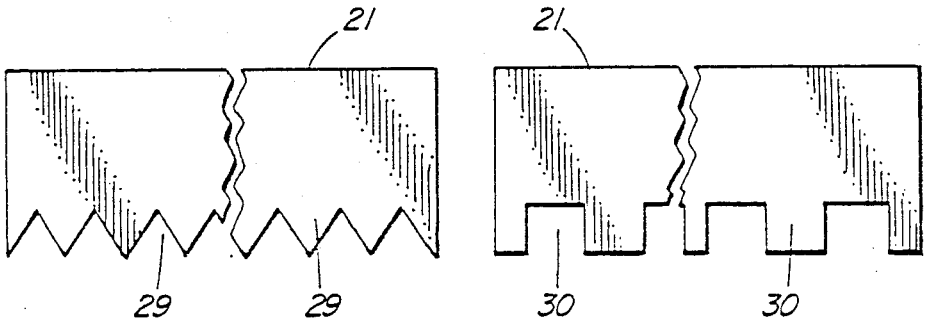
FIGS. 3*a* and 3*b* show alternative designs for a distributing profile for this device.

To improve the even distribution of the material, a vertically adjustable profile 21 can be arranged above the bottom part 20*b* and the lower end of this profile can be shaped with , e.g., serrations 29 or castellations 30, as shown in FIGS. 3*a* and 3*b*. It is also possible to attach adjustable deflecting or guiding elements 22 to the bottom 20*b* to improve the distribution further.

It is also suitable to fit an inspection port 24 to the box 17 to facilitate adjustment of the distributing devices.

A different principle for the distribution is shown at the distributing and segregating device 12 in FIGS. 4*a*–5*c*, which also gives a horizontal transportation towards the screen cloths. In this case, the material is fed through the inlet 25 of the box 23 and split into two flows by a roof-like element 26. Afterwards, the material falls onto the flaps 27 which have adjustable slopes (FIGS. 5*a*–5*c*).

After being split by the profile 26, the material moves on the flaps 27 by two means; the vibration will move it towards the screen cloths and the slopes will move it sideways.

The slanted shape of the flaps 27 will permit the material to flow over the outlet edge with an even thickness of the flow. The vertically adjustable profile 28 enables further shaping and directing of the flow of material; it could form a kind of weir or be arranged in a slanting fashion. When the material has left this outlet edge it falls onto a feeder plate where further segregation will take place, and from then onto the screen cloths. The inlet opening 25 can of course be shaped differently and also placed asymmetrically it the conditions so require.

What is claimed is:

1. A distributing and segregating device for a multideck screening machine which includes a frame housing a plurality of successive, superimposed screening decks, an inlet end through which material to be screened can be fed onto a upstream end of an upper deck, an outlet end having a plurality of outlets associated with overflows or underflows of one or more successive ones of said screening decks, and at least one vibrator for vibrating the frame, including said inlet end, for advancing material received through said inlet end, across and through the screening decks and to said outlets said device comprising a module adapted to be removably exchangeably supported on the frame of said multideck screening machine for vibration therewith at said inlet end as a means for feeding material to be screened into the multideck screening machine through said inlet end, and including:

wall means defining an enclosed box having an upwardly opening inlet and, transversally displaced from vertical registry with said inlet, a forwardly and downwardly opening outlet;

said wall means including a floor for said box, said floor having a sloping, gabled, medially ridged upstream portion disposed in vertical registry under said inlet and sloping down towards a juncture with a sloping downstream portion which is flatter by being less gabled and less medially ridged than said upstream portion; said downstream portion leading to said outlet at a downstream edge of said floor.

2. The distributing and segregating device of claim 1, further including:

at least one distributing component mounted to said wall means so as to have an elevated lower edge extending transversally of said device at a location spaced above said floor at a site disposed intermediate said inlet and said outlet for encountering and adjusting excesses in height of material being fed through said device to said multideck screening machine.

3. The distributing and segregating device of claim 2, wherein:

said lower edge of said distributing component is serrated.

4. The distributing and segregating device of claim 2, wherein:

said lower edge of said distributing component is castellated.

5. The distributing and segregating device of claim 2, further including:

at least two transversally neighboring deflectors mounted to and disposed upon said downstream portion of said floor for laterally deflecting material being fed over said floor towards said outlet.

6. The distributing and segregating device of claim 5, wherein:

said deflectors are movably mounted to said floor for providing adjustable deflection of said material.

7. A distributing and segregating device for a multideck screening machine which includes a frame housing a plurality of successive, superimposed screening decks, an inlet end through which material to be screened can be fed onto an upstream end of an upper deck, an outlet end having a plurality of outlets associated with overflows or underflows of one or more successive ones of said screening decks, and at least one vibrator for vibrating the frame, including said inlet end, for advancing material received through said inlet end, across and through the screening decks and to said outlets said device comprising a module adapted to be removably exchangeably supported on the frame of said multideck screening machine for vibration therewith at said inlet end as a means for feeding material to be screened into the multideck screening machine through said inlet end, and including:

wall means defining an enclosed box having an upwardly opening inlet and, transversally displaced from vertical registry with said inlet, a downwardly opening outlet;

said wall means including a floor for said box, said floor being downwardly sloping, gabled, medially ridged, from under said inlet to a downstream edge at said outlet;

said floor comprising two laterally adjacent flaps which adjoin along a medial ridge.

8. The distributing and segregating device of claim 7, wherein:

as seen in top plan, said downstream edge of said floor slants obliquely rearwardly in both lateral directions from said medial ridge.

9. The distributing and segregating device of claim 8, further including:

a respective guide member heightadjustably secured to each said flap along said downstream edge of said floor.

10. The distributing and segregating device of claim 7, further including:

an upwardly domed element mounted between said wall means in said box above said floor in vertical registry with said inlet, so that material which is to be screened, upon being introduced into said distributing and segregating device through said inlet, encounters and is deflected by said domed element before becoming supported on said floor.

11. The distributing and segregating device of claim 10, wherein:

said domed element is disposed for deflecting some of the material onto one of said flaps and some of the material onto the other of said flaps.

* * * * *